United States Patent [19]

Arakawa et al.

[11] Patent Number: 4,912,315

[45] Date of Patent: Mar. 27, 1990

[54] LONG PHOTOMULTIPLIER WITH TRANSLUCENT PHOTOCATHODE AND REFLECTOR

[75] Inventors: Satoshi Arakawa; Kenji Takahashi, both of Kanagawa; Hiroyuki Kyushima; Kazumi Yamashita, both of Shizuoka, all of Japan

[73] Assignee: Fuji Photo Film Co., Ltd., Kanagawa, Japan

[21] Appl. No.: 311,805

[22] Filed: Feb. 17, 1989

[30] Foreign Application Priority Data

Feb. 19, 1988 [JP] Japan ..... 63-37001

[51] Int. Cl.[4] ..... H01J 40/14

[52] U.S. Cl. ..... 250/207; 313/532

[58] Field of Search ..... 250/207, 213 JT; 313/528, 530, 532–536

[56] References Cited

U.S. PATENT DOCUMENTS 3,567,948 3/1971 Oke ..... 250/207

*Primary Examiner*—David C. Nelms

*Attorney, Agent, or Firm*—Sughrue, Mion, Zinn, Macpeak & Seas

[57] ABSTRACT

A long photomultiplier comprises a cylindrical main body having a light receiving face which extends in the longitudinal direction of the main body, a photocathode provided inside of the main body so that the photocathode extends along the light receiving face and emanates photoelectrons when exposed to light, and dynodes provided inside of the main body for multiplying the emanated photoelectrons. A reflection plate is provided facing and extending along the light receiving face, and the photocathode is positioned between the light receiving face and the reflection plate. The reflection plate is positioned for reflecting light, which has passed through the photocathode, toward the photocathode.

4 Claims, 3 Drawing Sheets

LONG PHOTOMULTIPLIER WITH TRANSLUCENT PHOTOCATHODE AND REFLECTOR

BACKGROUND OF THE INVENTION

1. Field of the Invention

This invention relates to a photomultiplier. This invention particularly relates to a long photomultiplier having a cylindrical main body with an elongated light receiving face that extends along the longitudinal direction of the main body.

2. Description of the Prior Art

When certain kinds of phosphors are exposed to radiation such as X-rays, $\alpha$-rays, $\beta$-rays, $\gamma$-rays, cathode rays or ultraviolet rays, they store part of the energy of the radiation. Then, when the phosphor which has been exposed to the radiation is exposed to stimulating rays such as visible light, light is emitted by the phosphor in proportion to the amount of energy stored during exposure to the radiation. A phosphor exhibiting such properties is referred to as a stimulable phosphor.

As disclosed in U.S. Pat Nos. 4,258,264, 4,276,473, 4,315,318 and 4,387,428 and Japanese Unexamined Patent Publication No. 56(1981)-11395, it has been proposed to use stimulable phosphors in radiation image recording and reproducing systems. Specifically, a sheet provided with a layer of the stimulable phosphor (hereinafter referred to as a stimulable phosphor sheet) is first exposed to radiation which has passed through an object such as the human body in order to store a radiation image of the object thereon, and is then exposed to stimulating rays, such as a laser beam, which cause it to emit light in proportion to the amount of energy stored during exposure to the radiation. The light emitted by the stimulable phosphor sheet upon stimulation thereof is photoelectrically detected and converted to an electric image signal, which is processed as desired to reproduce a visible image having an improved image quality, which allows the visible image to be used in making efficient and accurate diagnoses of illnesses.

In general, radiation image read-out apparatuses used in the aforesaid radiation image recording and reproducing systems are constituted of a main scanning means for scanning a stimulable phosphor sheet, on which a radiation image has been stored, with stimulating rays in a main scanning direction, i.e. along main scanning line, a sub-scanning means for moving the stimulable phosphor sheet with respect to the stimulating rays in a sub-scanning direction approximately normal to the main scanning direction, and a photo detecting means for detecting light emitted by the stimulable phosphor sheet in proportion to the amount of energy stored during exposure to radiation.

Recently, a novel photo detecting means which utilizes a long photomultiplier was proposed in, for example, Japanese Unexamined Patent Publication No. 62(1987)-16666. The disclosed long photo-multiplier is provided with a cylindrical main body having a light receiving face which extends along the main scanning line on the stimulable phosphor sheet. A photocathode is provided on an inner surface of the main body along the light receiving face. Also, in general, a light guide member is located so that it is in close contact with the light receiving face and so that it extends along the light receiving face and guides the light emitted by the stimulable phosphor sheet toward the photocathode. With the long photomultiplier, non-directional light emitted by the stimulable phosphor sheet is guided by the light guide member toward the photocathode. When exposed to light emitted by the stimulable phosphor sheet, the photocathode generates photoelectrons, which are sequentially multiplied by the secondary electron emission effects of dynodes.

With the aforesaid long photomultiplier, light emitted by every portion of the stimulable phosphor sheet in the main scanning direction can be detected efficiently. Also, radiation image read-out apparatuses using the long photomultiplier can be made smaller than apparatuses using a photomultiplier in which a light guide member having a complicated shape is located so that it is in close contact with a small light receiving face, as disclosed in, for example, Japanese Unexamined Patent Publication No. 54(1979)-87808.

However, the aforesaid long photomultiplier has a drawback in that a large number of photoelectrons cannot readily be emanated from the photocathode. Specifically, in order to generate a large number of photoelectrons in the photocathode, it is necessary to increase the light absorption efficiency of the photocathode. For this purpose, the photocathode should be made thicker. However, photoelectrons generated at positions deep within the width of the photocathode cannot readily be emanated out of the photocathode. From this viewpoint, the photocathode should be made thinner. These two incompatible requirements make it difficult for a large number of photoelectrons to emanate from the photocathode.

The problems described above with regard to the detection of light emitted by a stimulable phosphor sheet by using a long photomultiplier also arise when other types of light are detected with the long photomultiplier.

SUMMARY OF THE INVENTION

The primary object of the present invention is to provide a long photomultiplier wherein a large number of photoelectrons are emanated from a photocathode.

Another object of the present invention is to provide a long photomultiplier which can detect weak light signals and produce electric image signals having high signal-to-noise ratios.

The present invention provides a long photomultiplier comprising cylindrical main body having a light receiving face which extends in the longitudinal direction of the main body, a photocathode provided inside of the main body so that the photocathode extends along the light receiving face and emanates photoelectrons when exposed to light, and dynodes provided inside of the main body for multiplying the emanated photoelectrons, wherein the improvement comprises:

(i) a reflection plate being provided so as to face and extend along said light receiving face, (ii) said photocathode being positioned between said light receiving face and said reflection plate, and (iii) said reflection plate being positioned so as to reflect light, which has passed through said photocathode, toward said photocathode.

When the photocathode is positioned between the light receiving face and the reflection plate, and light such as light emitted by a stimulable phosphor sheet travels toward the reflection plate, the light passes the photocathode at least twice, i.e. once at the time the light advances toward the reflection plate and once after the light is reflected by the reflection plate toward the photocathode. Therefore, a larger number of photoelectrons are emanated by the photocathode than when light passes through the photocathode only once. Accordingly, with the long photomultiplier in accordance with the present invention, a weak light signal can be detected.

DESCRIPTION OF THE PREFERRED EMBODIMENTS

The present invention will hereinbelow be described in further detail with reference to the accompanying drawings.

Figure 2:
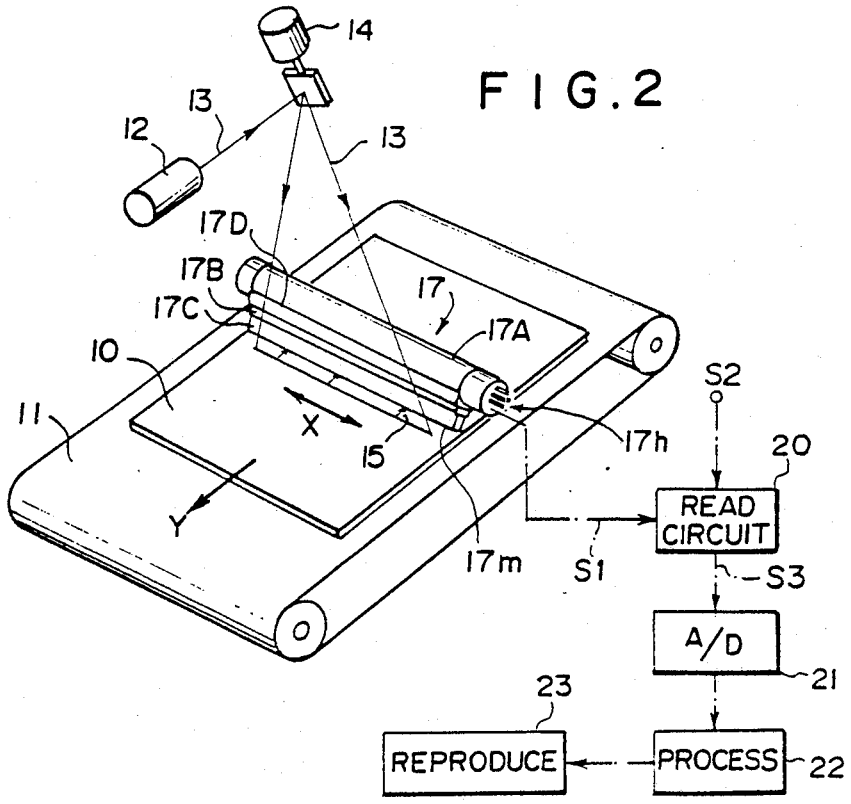
FIG. 2 is a perspective view showing an embodiment of the radiation image read-out apparatus in accordance with the present invention wherein the long photomultiplier shown in FIG. 1 is employed.

FIG. 2 shows a radiation image read-out apparatus wherein light emitted by a stimulable phosphor sheet 10 in proportion to the amount of energy stored during exposure to radiation is detected by a long photomultiplier 17. The stimulable phosphor sheet 10 carrying a radiation image of an object stored thereon, by way of example, by being exposed to radiation which has passed through the object, is moved by a sheet movement means 11 constituted of an endless belt or the like in a sub-scanning direction indicated by the arrow Y. At the same time, a laser beam 13 produced by a laser beam source 12 is deflected by a light deflector 14, which may be a galvanometer mirror or the like, and scans the stimulable phosphor sheet 10 in a main scanning direction indicated by the arrow X, which is approximately normal to the sub-scanning direction indicated by the arrow Y. When the stimulable phosphor sheet 10 is thus exposed to the laser beam 13, the exposed portion of the stimulable phosphor sheet 10 emits light 15 with an intensity proportional to the amount of energy stored during exposure to radiation. The emitted light 15 is detected by a long photomultiplier 17 as will be described later. An output S1 of the long photomultiplier 17 which represents the intensity of the emitted light 15 is fed to a read-out circuit 20 which processes it in various ways, such as amplifying it or carrying out a logarithmic conversion on it. Also, the output S1 is integrated over a predetermined period, which period is clocked by a synchronizing signal S2 which is based on the timing of the scanning of the laser beam 13, so that an analog read-out image signal S3, which is divided into sequential picture elements is obtained from the read-out circuit 20. By way of example, the read-out image signal S3 is digitized by an A/D converter 21, and fed to an image processing circuit 2, which carries out signal processing (image processing), such as gradation processing or frequency response processing, thereon. Then, the read-out image signal S3 is fed to an image reproducing apparatus 23 constituted of a CRT, a printer or the like, and is used to reproduce the radiation image, which was stored on the stimulable phosphor sheet 10, as a visible image.

Figure 1:
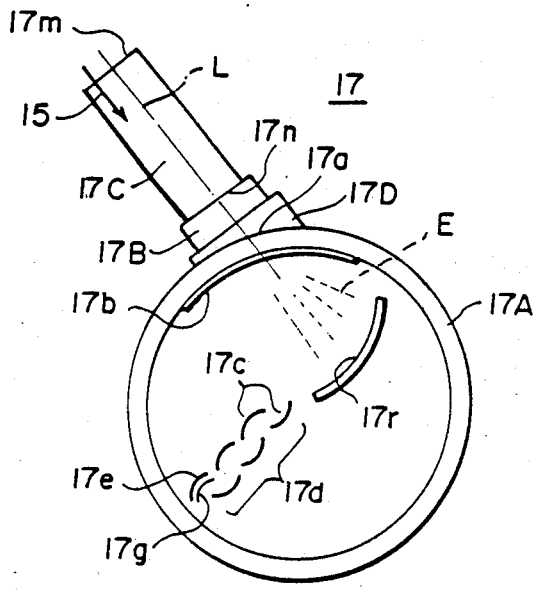
FIG. 1 is a sectional side view showing an example of the long photomultiplier utilized in accordance with the present invention.

The long photomultiplier 17 will hereinbelow be described in detail with reference to FIG. 1. In FIG. 1, similar elements are numbered with the same reference numerals with respect to FIG. 2. The long photomultiplier 17 has a cylindrical main body 17A which is constituted of glass and which has been evacuated. A photocathode **17*b* is provided on an inner surface of the main body 17A so that the photocathode 17*b* faces an elongated light receiving face 17*a* which extends in the longitudinal direction of the main body 17A. A reflection plate 17*r* is provided inwardly from the photocathode 17*b*. Also, a multiplying section 17*d* composed of a plurality of dynodes 17*c*, 17*c*, . . . having secondary electron emission effects is provided inside of the main body 17A. A shield electrode 17*e* is positioned facing the dynode 17*c* at the left end of the multiplying section 17*d*, and an anode 17*g* for collecting the electron streams, which were multiplied by the multiplying section 17*d*, and generating a signal therefrom is positioned inwardly from the shield electrode 17*e*. These electrodes are electrically connected in a one-to-one relation to the terminals in a terminal group 17*h* provided at a side extremity of the main body 17A. The reflection plate 17*r*, the dynodes 17*c*, 17*c*, . . . the shield electrode 17*e* and the anode 17*g* have lengths approximately equal to the length of the photocathode 17*b***.

A transparent adapter 17D and a filter 17B are provided on the light receiving face **17*a* of the main body 17A. By way of example, the filter 17B substantially transmits the emitted light 15 and filters out light from the laser beam 13, which is reflected by the stimulable phosphor sheet 10. A light guide member 17C constituted of glass or the like is located so that it is in close contact with the filter 17B. The filter 17B and the light guide member 17C have lengths approximately equal to the length of the photocathode 17*b*. The long photomultiplier 17 is provided so that an elongated outer edge face 17*m* of the light guide member 17C extends along and close to the line along which the laser beam scans (main scanning line) the stimulable phosphor sheet 10. Also, the light guide member 17C is provided so that an imaginary line L, which passes through a point at the center of the outer edge face (light input face) 17*m* and a point at the center of an inner edge face (light output face) 17*n*, forms an acute angle at its intersection with the photocathode 17*b***.

Figure 3:
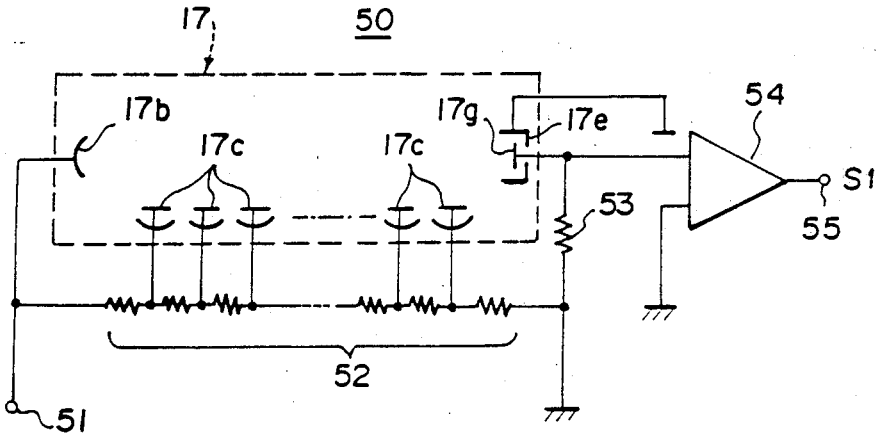
FIG. 3 is a circuit diagram showing an electric circuit for the long photomultiplier shown in FIG. 1, and FIGS. 4 and 5 are sectional side views showing further embodiments of the long photomultiplier in accordance with the present invention.

FIG. 3 shows an electric circuit 50 for operating the long photomultiplier 17 and obtaining a photoelectric output therefrom. In FIG. 3, similar elements are numbered with the same reference numerals with respect to FIG. 1. A high negative voltage is applied to the photocathode **17*b* at a high negative voltage applying terminal 51. The high negative voltage applied to the high negative voltage applying terminal 51 is divided by a bleeder resistance group 52 into voltages which are applied respectively to the dynodes 17*c*, 17*c*, . . . The shield electrode 17*e* is grounded. The anode 17*g* is connected to the bleeder resistance group 52 via a resistor 53, and is connected to one of terminals of an amplifier 54**.

The light 15 emitted by the stimulable phosphor sheet 10 enters the light guide member 17C through its outer edge face **17*m*, is guided inside of the light guide member 17C, and radiated out of the inner edge face 17*n*. The light 15 then passes through the filter 17B and the light receiving face 17*a***, impinges upon the photocathode 17*b* and causes it to emanate photoelectrons E. The photoelectrons E advance directly toward the dynodes 17*c*, 17*c*, in accordance with the electric field.

The reflection plate 17*r* is positioned so that the light 15, after passing through the photocathode 17*b*, is reflected back to the photocathode 17*b*. Therefore, photoelectrons E are also emanated from the photocathode 17*b* when the light 15 after being reflected by the reflection plate 17*r* impinges again upon the photocathode 17*b*. The photoelectrons E thus emanated also advance toward the dynodes 17*c*, 17*c*, . . .

With the long photomultiplier 17, the light 15 passes through the photocathode 17*b* at least twice. (The light 15 may pass through the photocathode 17 more than twice. Specifically, the light 15 after being reflected by the reflection plate 17*r* may be reflected by the inner surface of the main body 17A, pass through the photocathode 17*b* again, and thus impinge once more upon the photocathode 17*b*.) Therefore, the efficiency with which the photoelectrons E are generated can be increased compared to a conventional long photomultiplier wherein light passes through a photocathode only once.

When the photoelectrons E flow toward the anode 17*g*, they impinge upon the dynodes 17*c*, 17*c*, . . . , and cause the dynodes 17*c*, 17*c*, to emanate secondary electrons. In this manner, the photoelectrons are multiplied sequentially by the dynodes 17*c*, 17*c*, . . . The current obtained in this manner is fed to the amplifier 54. Therefore, an analog electric signal S1 representing the intensity of the emitted light 15, i.e. the image which was stored on the stimulable phosphor sheet 10, is delivered to an output terminal 55 of the amplifier 54.

In the aforesaid embodiment, the light guide member 17C is inclined with respect to the photocathode 17*b* as described above. This configuration also contributes to the emanation of a larger number of photoelectrons E from the photocathode 17*b*. This effect will hereinbelow be described in detail. The light 15 emitted by the stimulable phosphor sheet 10 is non-directional, and therefore the light 15 is radiated at various angles from the light output face 17*n* of the light guide member 17C. However, when the light guide member 17C is inclined with respect to the photocathode 17*b*, the probability that the light 15 will impinge obliquely upon the photocathode 17*b* is higher than in a conventional long photomultiplier wherein the light guide member 17C stands upright so that said imaginary line L, described hereinbefore, is parallel to a radius of the main body 17A. When the light 15 impinges obliquely upon the photocathode 17*b*, the light 15 travels over a larger distance when passing therethrough. As a result, the amount of light 15 absorbed in the photocathode 17*b* increases, and a larger number of photoelectrons E are generated.

With the long photomultiplier 17, the light 15 passes through the photocathode 17*b* at least twice, and the amount of the light 15 absorbed in the photocathode 17*b* increases. Therefore, the photocathode 17*b* need not be made particularly thick in order to increase the amount of light 15 absorbed in the photocathode 17*b*. When the photocathode 17*b* is comparatively thin, the photoelectrons E are generated in the vicinity of the surface of the photocathode 17*b*, and can readily be emanated from the photocathode 17*b*.

Figure 4:
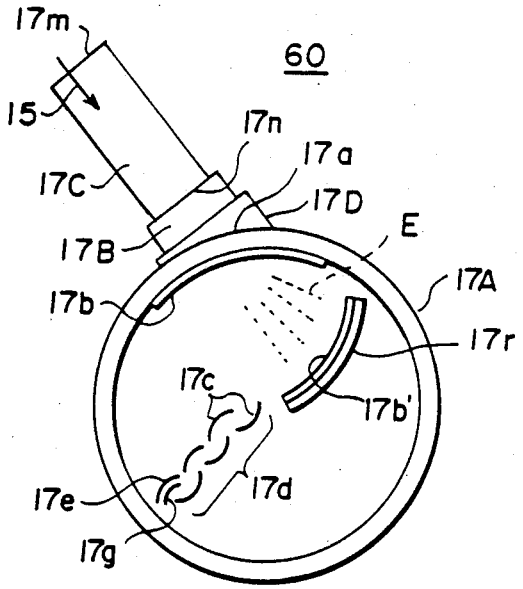

Another embodiment of the long photomultiplier in accordance with the present invention will hereinbelow be described with reference to FIG. 4. In FIG. 4, similar elements are numbered with the same reference numerals with respect to FIG. 1. (This also applies to FIG. 5.) With reference to FIG. 4, a long photomultiplier 60 is also provided with a photocathode 17*b*' on the light receiving surface of the reflection plate 17*r*. Therefore, in this embodiment, the photoelectrons E are emanated by the photocathode 17*b* provided on the inner surface of the main body 17A in the same manner as that described above. Photoelectrons E are also emanated when the light 15 passes through the photocathode 17*b*' as it travels toward the reflection plate 17*r* and when the light 15, after being reflected by the reflection plate 17*r*, passes through the photocathode 17*b*'. Accordingly, photoelectrons can be generated with a higher efficiency.

A further embodiment of the long photomultiplier in accordance with the present invention will hereinbelow be described with reference to FIG. 5. In a long photomultiplier 70, a comparatively wide photocathode 75 is provided on an inner surface of the main body 17A, and a reflection plate 71 is provided on an outer surface of the main body 17A outside of the photocathode 75. Also, reflection plates 72 and 73 are provided inside of the main body 17A so that they face the photocathode 75. A first dynode 17*c* (the top dynode in FIG. 5) is positioned between the reflection plates 72 and 73 so that the first dynode 17*c* faces the photocathode 75. The reflection plate 71 faces the first dynode 17*c*, and part of the reflection plate 71 faces the light receiving face 17*a*.

Figure 5:
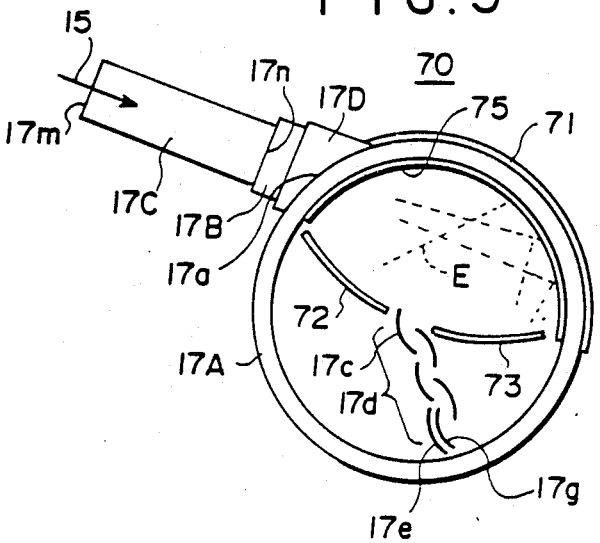

With the configuration shown in FIG. 5, the light 15 entering the main body 17A through the light receiving face 17*a* passes through one end portion of the photocathode 75 in accordance with the angle of incidence of the light 15 upon the photocathode 75, and advances inside of the main body 17A. The light 15 then impinges upon the other end portion of the photocathode 75, and causes it to emanate photoelectrons E. The emanated photoelectrons E advance directly toward the dynode 17*c*. Also, light 15 which has passed through the photocathode 75 toward the exterior of the main body 17A is reflected by the reflection plate 71, and thus passes through the photocathode 75 again. Photoelectrons E are also emanated when the light 15 passes through the photocathode 75 again, and they advance directly toward the dynode 17*c*.

Part of the light 15, after being reflected by the reflection plate 71 and passing through the photocathode 75 again, is reflected by the reflection plate 72 or the reflection plate 73, and impinges upon the photocathode 75. This part of the light 15 also causes the photocathode 75 to emanate photoelectrons E. Light 15 which has passed through the one end portion of the photocathode 75 toward the reflection plate 72 or the reflection plate 73 is reflected by the reflection plate 72 or 73, impinges upon the photocathode 75, and causes it to emanate photoelectrons E. Accordingly, with the long photomultiplier 70, the efficiency with which photoelectrons are generated is improved markedly.

The present invention is not limited to long photomultipliers having the electrode configurations described above, and is applicable also to long photomultipliers having different electrode configurations, for example, a venetian blind type electrode configuration or a box type electrode configuration disclosed in Japanese Unexamined Patent Publication No. 62(1987)-16666.

Of course, the long photomultiplier in accordance with the present invention can also be utilized for detecting light different from light 15 emitted by a stimulable phosphor sheet 10.

We claim:

1. A long photomultiplier comprising a cylindrical main body having a light receiving face which extends in the longitudinal direction of the main body, a photocathode provided inside of the main body so that the photocathode extends along the light receiving face and emanates photoelectrons when exposed to light, and dynodes provided inside of the main body for multiplying the emanated photoelectrons, wherein the improvement comprises:

(i) a reflection plate being provided so as to face and extend along said light receiving face, (ii) said photocathode being positioned between said light receiving face and said reflection plate, and (iii) said reflection plate being positioned so as to reflect light, which has passed through said photocathode, toward said photocathode.

2. A long photomultiplier as defined in claim 1 wherein said reflection plate is positioned inside of said main body.

3. A long photomultiplier as defined in claim 2 wherein a second photocathode is provided on a surface of said reflection plate, which surface faces said light receiving face.

4. A long photomultiplier as defined in claim 1 wherein said reflection plate is positioned on an outer surface of said main body outside of said photocathode so that part of said reflection plate faces said light receiving face, and a second reflection plate is provided inside of said main body so as to face said photocathode.

* * * * *

UNITED STATES PATENT AND TRADEMARK OFFICE

CERTIFICATE OF CORRECTION

PATENT NO. : 4,912,315

DATED : MARCH 27, 1990

INVENTOR(S) : SATOSHI ARAKAWA ET AL.

It is certified that error appears in the above-identified patent and that said Letters Patent is hereby corrected as shown below:

Title page:

Please change assignee from "Fuji Photo Film Co., Ltd." to --Fuji Photo Film Co., Ltd. and Hamamatsu Photonics Kabushiki Kaisha--.

Signed and Sealed this

Eleventh Day of June, 1991

*Attest:*

*Attesting Officer*

HARRY F. MANBECK, JR.

*Commissioner of Patents and Trademarks*